US005849018A

United States Patent [19]

Rosson et al.

[11] Patent Number: 5,849,018

[45] Date of Patent: Dec. 15, 1998

[54] MECHANICAL EPILATOR FOR PULLING HAIR FROM THE SKIN WHILE THE SKIN IS BEING NUMBED

[75] Inventors: Yves Rosson, Amberieuz-en-Dombes; Bernard Beillard, Lyons, both of France

[73] Assignee: SEB S.A., Ecully, France

[21] Appl. No.: 433,473

[22] PCT Filed: Sep. 14, 1994

[86] PCT No.: PCT/FR94/01078

§ 371 Date: Oct. 6, 1995

§ 102(e) Date: Oct. 6, 1995

[87] PCT Pub. No.: WO95/07638

PCT Pub. Date: Mar. 23, 1995

[30] Foreign Application Priority Data

Sep. 15, 1993 [FR] France ..... 93 10986
Mar. 9, 1994 [FR] France ..... 94 02716

[51] Int. Cl.[6] ..... A61B 17/50

[52] U.S. Cl. ..... 606/133; 606/131

[58] Field of Search ..... 606/133, 43, 36, 606/1, 22, 25, 9; 401/208, 219; 601/17–19, 12, 15

[56] References Cited

U.S. PATENT DOCUMENTS 4,279,253 7/1981 Haes et al. ..... 606/133
4,646,735 3/1987 Seney ..... 606/22
5,279,080 1/1994 Miller et al. ..... 51/393
5,346,499 9/1994 Garenfeld et al. ..... 606/133
5,645,825 7/1997 Hillebrand et al. ..... 424/73

FOREIGN PATENT DOCUMENTS 0493849 1/1990 European Pat. Off. .
0348862 7/1992 European Pat. Off. .
2454283 12/1980 France .
2 675 354 10/1992 France .
9310986 9/1993 France .

*Primary Examiner*—Richard J. Apley
*Assistant Examiner*—Justine R. Yu
*Attorney, Agent, or Firm*—Pillsbury Madison & Sutro

[57] ABSTRACT

A mechanical epilator (1) for pulling hairs from the skin (P), the epilator (1) including an epilator member (6), e.g., constituted by a roller (60) made up of disks and of blades, that is rotatable about an axis (61) and that is driven by an electric motor (3), in association with a mechanical coupling member (7). The epilator further includes, or is associated with, a moistening member for moistening the skin (P). Finally, it includes a fan system (4), likewise driven by the motor (3) and serving to lower the surface temperature of the skin by the effect of forced evaporation, thereby numbing the skin. Moistening may also be achieved by spraying water onto the skin.

21 Claims, 5 Drawing Sheets

MECHANICAL EPILATOR FOR PULLING HAIR FROM THE SKIN WHILE THE SKIN IS BEING NUMBED

TECHNICAL FIEND

The invention relates to a mechanical epilator that pulls hairs from the skin while avoiding pain.

PRIOR ART

Epilation that is performed mechanically, i.e. by pulling hairs from the skin, is an operation that is generally rather painful.

This operation can be performed by means of various well-known portable appliances. By way of non-limiting example, one such appliance is described in French patent application FR-A-2 675 354, in the name of SEB S.A. The appliance taught by that French patent application is an epilator of the type having pinching blades. It comprises a housing that is designed to be held in the hand and that contains an electric motor connected to a rotary roller carrying means for pinching and pulling out hairs.

Appliances of that type, or appliances that perform the function of pulling out hairs by implementing analogous mechanical methods, perform the function they are required to perform in satisfactory manner. However, as mentioned above, pulling out hairs is painful.

SUMMARY OF THE INVENTION

It is also well known that low temperatures are numbing.

Taking advantage of this observation, the invention has the object of providing a mechanical epilator which, while retaining the functionality of prior art appliances, makes it possible simultaneously to eliminate, or at least to greatly attenuate, the sensation of pain caused by pulling out hairs.

To be able to do this, the epilator is provided with means enabling the zone of skin that is to be epilated to be cooled down, before or during the pulling out of hairs from the skin and drive means for driving the epilator means. In fact, this action also continues after the operation.

There are thus at least two stages:

before: the skin is prepared for numbing; and after: the cooling soothes and comforts.

According to an important characteristic of the inventions the skin is cooled remotely. To do this, a fluid is placed on the skin by various means: an applicator roller, spray. etc. . . . Thereafter evaporation of the fluid is forced by means of a fan system, thereby reducing the temperature of the surface of the skin by a few degrees.

The fluid may be water, or a substance that is more volatile, e.g. an alcohol solution, or it may be an antiseptic substance or a hypoallergenic substance.

In a first embodiment, the skin is moistened by means of a moistening roller which is itself moistened by a fluid contained in a self-contained tank.

In a variant of this embodiment, the moistening roller serves itself as the tank.

In general, epilator means (e.g. a roller made up of disks and of blades as described in the above-specified French patent application) are driven by an electric motor incorporated in the housing of the appliance.

Advantageously, the fan system is constituted by a fan that is also driven by the motor for driving the epilator means.

In this first embodiment, the skin is moistened prior to the operation of epilation, with the moistening means (e.g. a roller) being situated upstream from the epilator means relative to the displacement direction of the appliance over the skin.

In an additional variant of this embodiment, it is also possible to obtain moistening and epilation simultaneously.

Finally, in a second embodiment, moistening of the skin is obtained by spraying on the fluid.

The invention thus provides a mechanical epilator that pulls out hairs from the skin, the epilator comprising a portable housing containing epilator means for said pulling out of hairs characterized in that it is associated with means for moistening the skin over a determined zone thereof by means of a fluid, and in that it comprises drying means for drying said determined zone of skin so as to obtain the evaporation of said fluid and a reduction in the surface temperature of said zone of said skin giving rise to at least partial numbness thereof while hairs are being pulled out therefrom.

The mechanical epilator of the invention thus makes it possible to obtain in simple manner mechanical epilation that is effective, i.e. it retains all of the functionality of the prior art appliance provided for this purpose. However, it enables this epilation operation to be performed under conditions of comfort that are not available using said prior art appliances, i.e. enabling the sensation of pain that accompanies the operation of epilation to be greatly attenuated or even eliminated.

In addition, this advantageous characteristic is obtained without it being necessary to make the structure of the epilator correspondingly more complicated. In particular, advantage can be taken of the almost universal presence of an electric motor for driving the epilator means. It suffices merely to add a fan to said motor, and indeed such a fan may already exist for the purpose of cooling the motor itself.

BRIEF DESCRIPTION OF THE DRAWINGS

The invention will be better understood and other characteristics and advantages will appear on reading the following description given with reference to the accompanying drawings, in which.

In what follows, elements in the figures that perform functions that are identical, or at least similar, carry the same references and are described again only where necessary. For purposes of simplification, the term "epilator" is used to designate an appliance that performs mechanical epilation by pulling out hairs.

BEST MODE OF PRACTICING THE INVENTION

Figure 1:
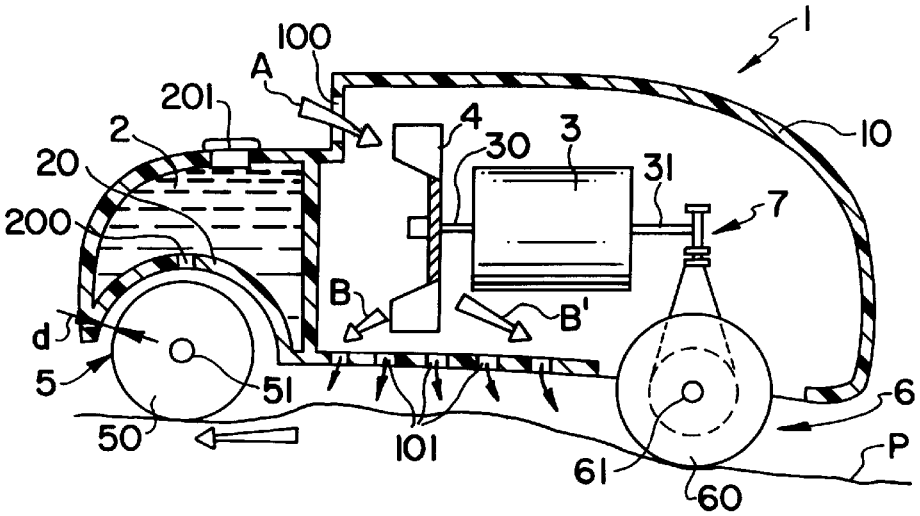
FIG. 1, is a diagram showing a first embodiment of a mechanical epilator of the invention.

FIG. 1 is a diagram of a first variant of a first embodiment of the invention.

In conventional manner, the epilator 1 comprises a housing 10 of a shape adapted to be held in the hand. Likewise in conventional manner, the housing contains epilator means proper given general reference 6, a drive motor 3 for rotating a shot 30, 31, and mechanical coupling means given general reference 7. The coupling means may be constituted by gear trains driven by the end 31 of the drive shaft of the motor 3, optionally in association with drive belts (as shown in FIG. 1) or with any other conventional means. The motor may be powered by external means connected to mains, or preferably by cordless means (batteries, rechargeable or otherwise). These means are not shown.

The elements described above are common to the prior art and reference may advantageously be made to the above-specified French patent application for a more detailed description of one possible way of implementing the epilator proper in the appliance of the invention.

In this example, the epilator means 6 are constituted, as mentioned above, by a roller 60 made up of pinching and pulling out means (not shown) that rotate about a shaft that has one of its ends, 61, visible in FIG. 1.

The solid arrow near the bottom of the figure indicates the direction in which the epilator 1 moves in contact with the zone of skin P to be epilated. The cooling which gives rise to numbness of the skin P needs to be performed prior to pulling out the hairs.

In this version of the invention, the means for moistening the skin P and for cooling it remotely are incorporated in the epilator 1.

In the embodiment shown in FIG. 1, moistening is performed by means of a member 5 comprising a roller 50 that rotates about a shaft having one of its ends 51 visible in the figure. The roller 50 is fed with fluid from a tank 2 in a manner that is explained below.

To cool the skin remotely, the appliance 1 is provided with a blower 4 or with an equivalent member. Advantageously, the fan 4 is mounted on the end 30 of the rotary shaft of the motor 3. It could equally well be driven by the mechanical coupling member 7 without going beyond the ambit of the invention.

A first opening 100 is provided in the housing 10 and is preferably provided with a grid or a similar element for the purpose of sucking in ambient air (arrow A). A second opening 101, likewise preferably provided with a grid or a similar element, serves to evacuate the air blown by the fan 4 towards the skin P (arrows B and B').

The epilator 1 of the invention operates as explained below.

The roller 50 is moistened and it is maintained in that state. Preferably, the roller is constituted by material that is spongy or hydrophilic, e.g. a hydrophilic foam, at least on its periphery.

The roller 50 moistened in this way is then applied to the skin P where it is to be epilated. The fan 4 blows a Jet of ambient air (beneath the opening 101) at a point that is behind the roller 50 relative to the displacement direction (black arrow).

When the appliance 1 is moved over the skin P, the roller 50 rotates and moistens the skin P. The skin is then dried by the flow of air that is produced. This forced surface evaporation of the water (or more generally of the fluid) gives rise to a cooling effect in a manner that is well known from the laws of physics. The skin is thus cooled down considerably with a large quantity of heat being taken away, thereby causing the surface temperature of the treated zone to drop by a few degrees, typically 4° C. to 5° C. This phenomenon generates numbness, at least partially, in the zone of skin P to be epilated. Thereafter, epilation proper takes place when the roller 60 (or more generally the mechanical epilator means) reaches the previously cooled zone.

The means enabling fluid to be dispensed to the roller 5 are now described.

In the embodiment shown in FIG. 1, a tank 2 is provided inside the housing 10 for the purpose of storing the fluid that is dispensed onto the roller 50 for the purpose of moistening it. The tank is constituted by a cavity whose bottom wall 20 (in the example illustrated), in a zone that faces the roller 50, follows the shape thereof, i.e. it is substantially cylindrical in shape. This wall portion is provided with at least one orifice 200 facing the roller 50. Advantageously, this wall portion is provided with a row of orifices 200 that are parallel to and that overlie a generator line of the roller. The tank 2 includes a stopper 201 or an analogous element that serves to close it once it has been filled with fluid. In general the fluid is water, however any appropriate solution could be added thereto.

The mean gap or clearance "d" between the surface of the roller 50 and the facing wall is designed so that the roller fills by capillarity with the water (or more generally the liquid) that is contained in the tank 2.

The orifices 200 are then "drowned" and air can no longer penetrate into the tank 2 for the purpose of compensating the loss of water therefrom, and this has the effect of stopping the flow. The zone of the roller 50 facing the wall is soaked in water.

When the roller 50 rotates, the film of water occupying the gap of thickness "d" is entrained with the roller and is deposited on the skin in the zone to be epilated. Air is again free to penetrate via the orifice(s) 200 so water can flow back towards the roller 50, thereby compensating the quantity that has already been deposited.

As shown, the fan 4 generally comprises a central body provided with peripheral fins. However other types of fan, turbine, or similar member may naturally be implemented within the ambit of the invention.

Figure 2:
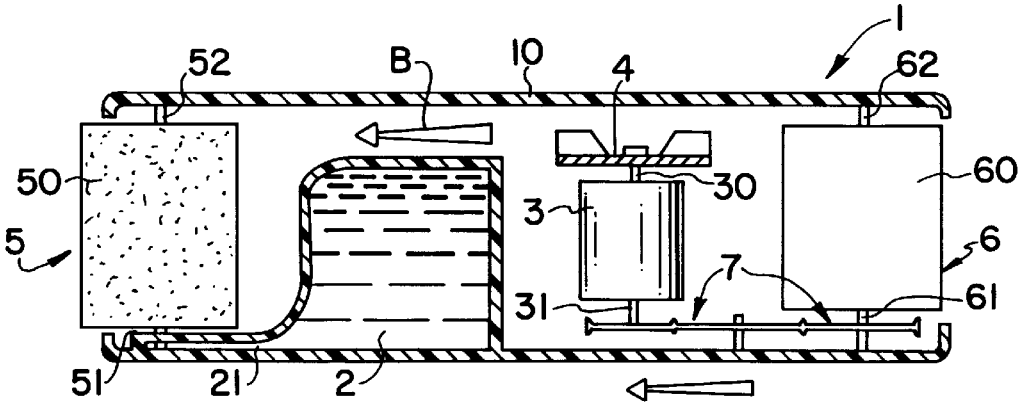
FIG. 2 is a diagram showing a first variant of this embodiment.

FIG. 2 shows a variant of the embodiment described above. The epilator 1 comprises, as before, a housing 10 of appropriate shape containing a motor 3 that drives the mechanical epilator means 6 via a mechanical coupling member 7; gears, etc. . . . The motor also drives a turbine 4 disposed on the end 30 of its drive shaft. The turbine blows cold air (arrow B) in a substantially longitudinal direction (direction shown by bottom solid arrow).

In this variant, the fluid contained in the tank 2 feeds the moistening roller 50 via a channel 21 which opens out at one of the ends 51 of the shaft on which the roller rotates. The shaft is hollow, at least in part, so as to define a channel including orifices (not shown) enabling the roller 50 to be soaked. This is made of a hydrophilic material. The fluid dispensed to the roller diffuses towards its outside surface and moistens the skin when the roller 50 comes into contact therewith and while it rotates about its shaft 51–52.

Figure 3A:
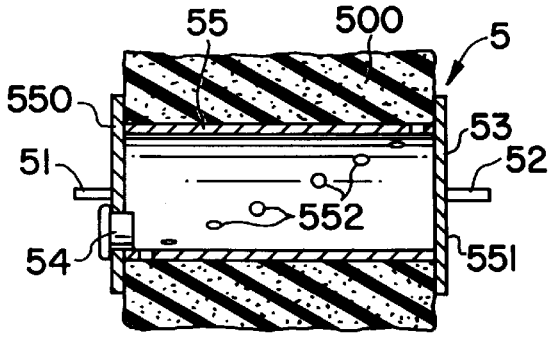
FIGS. 3A and 3B are diagrams showing a second variant of this embodiment.
Figure 3B:
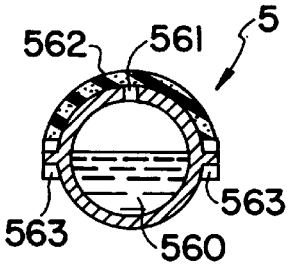

FIGS. 3A and 3B show an additional embodiment in which the fluid tank is integrated within the moistener member 5.

For this purpose, in the example of FIG. 3A, the moistener member 5 comprises a drum 55 having two end walls 550 and 551, that are advantageously of greater diameter than the drum 55, thereby ensuring that it is generally reel-shaped. A peripheral ring 500 of hydrophilic or spongy material is disposed around the drum 55.

The drum 55 contains the fluid and it is provided with orifices 552 that provide communication between the inside of the drum 55 and the spongy hydrophilic material 500. The material is thus soaked with the liquid contained inside the drum 55.

To insert the fluid into the drum 55, it is possible to provide an orifice in one of the side walls (e.g. the wall 550), which orifice is closed in operation by a plug 54 or by any suitable element.

In the example of FIG. 3B, the moistener member 5 comprises a tank 560 in the form of a roller and a rubber 562 of hydrophilic material placed on the tank over a fraction of the surface of the roller that is adapted to come into contact with the skin. The tank 560 is stationary, the skin being moistened by back-and-forth friction between the rubber 562 and the skin.

The rubber 562 is moistened by holes 561 provided through the surface of the tank 560. It is mounted on the tank by mechanical means 563 such as a clamping nut. The rubber 562 may equally well be glued by means of an adhesive on the surface of the tank 560.

In the embodiment described above, the operation of moistening and cooling the skin P is performed prior to the operation of epilation proper, and it continues after said operation (so far as cooling is concerned).

Figure 4:
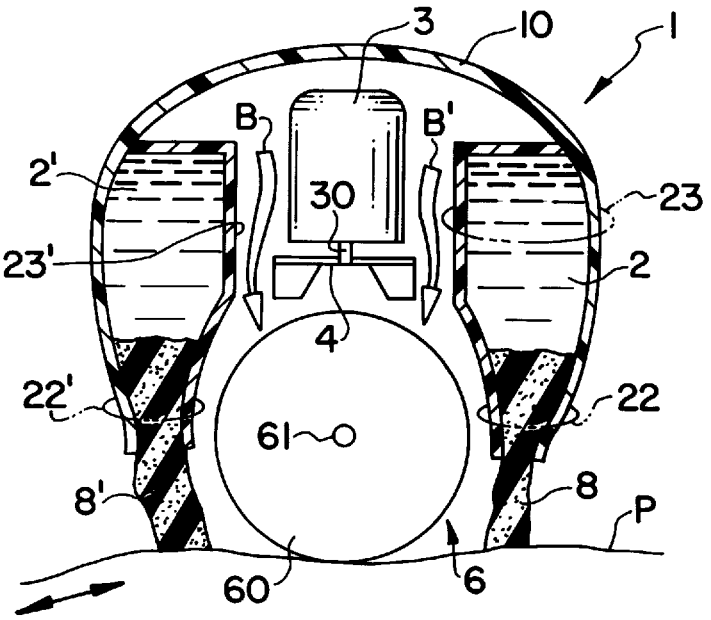
FIG. 4 is a diagram showing a second embodiment in which moistening and epilation are obtained simultaneously.

In the embodiment shown in FIG. 4, these two operations take place substantially simultaneously, and cooling continues after epilation proper.

The fan member 4 is disposed above the epilator roller 60 (in the example shown). As before, it is driven by the motor 3 which also serves to drive the roller 60 via members that are not shown. These members are similar to those described above (FIGS. 1 and 2 :item 7).

Still in the context of the embodiment shown, two tanks 2 and 2' are provided on either side of the roller 6. The bottom ends of, these tanks 2 and 2' (respectively 22 and 22') are advantageously narrower than the top zones 23 and 23' thereof. This disposition makes it possible to "clamp" two elements 8 and 8' of spongy material that are designed to be put into contact with the skin P. The length of the elements 8 and 8' is preferably not less than the length of the roller 60 so as to cover and moisten the entire zone of skin P that is to be epilated. In this variant embodiment, moistening takes place by capillarity or drop-by-drop.

By placing two tanks 2 and 2' on either side of the roller 60, it is possible to ignore the direction of motion (double-headed black arrow) of the epilator 1 over the skin P. Nevertheless, it would be possible to provide one tank only, e.g. the tank 2.

It will be understood that the fan, by blowing a jet of cold air (arrows B and B') against and around the roller 60 makes it possible to cool the skin, still by forced evaporation, while the epilation operation is being performed simultaneously.

Suction orifices (not shown) are formed through the wall of the housing 10, preferably in zones away from those whereby the appliance 1 is held, so as to avoid the orifices being covered, since that could give rise to faulty operation. Even if moistening of the skin is performed properly, the fan would then not operate correctly and the looked-for numbing effect of the skin P due to cooling would not take place.

Figure 5:
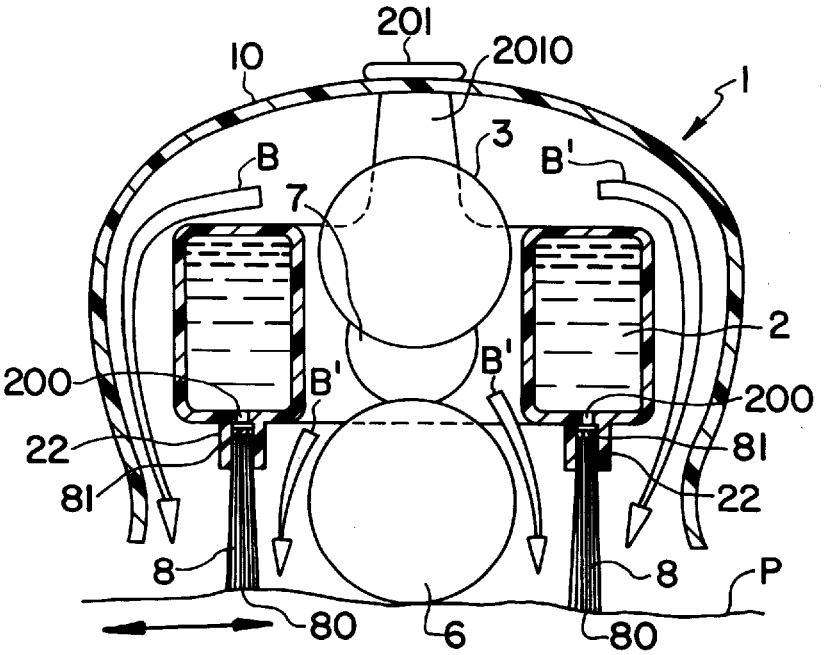
FIGS. 5 and 6 show a variant of the FIG. 4 embodiment.
Figure 6:
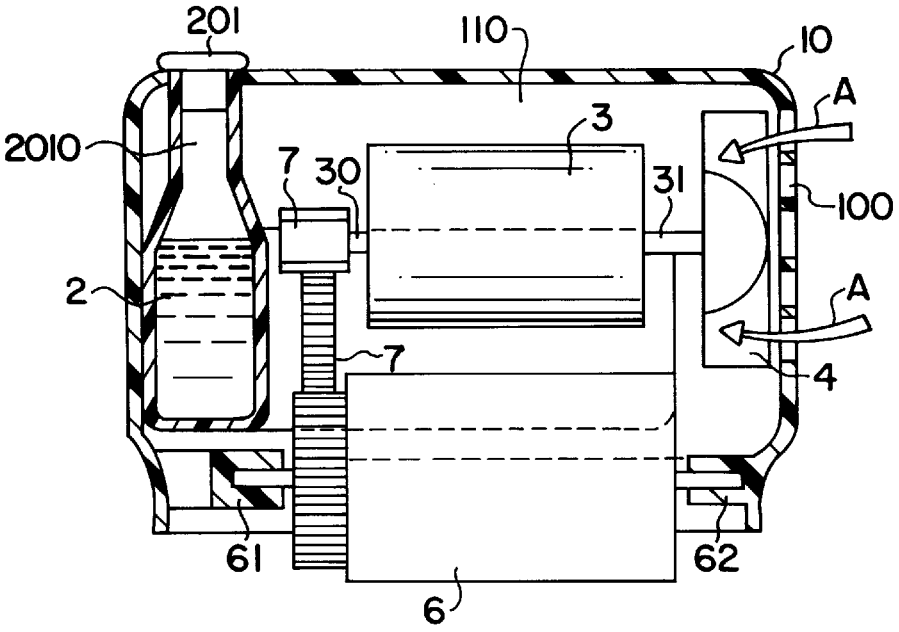

A variant of the embodiment described above with reference to FIG. 4 is shown in FIGS. 5 and 6. This variant is a preferred variant of the present embodiment since it provides increased effectiveness.

FIGS. 5 and 6 are fragmentary sections through the appliance on orthogonal axes.

As before, the ventilation member is constituted by a propeller fan 4 or by a similar element. It is driven by an electric motor 3. It is placed above the roller and its axis of rotation is parallel thereto. The motor 3 drives the roller 6 in a set of gears 7.

The appliance 1 includes a single fluid tank 2 in the form of a horizontal U-shape. The branches of the U-shape are disposed in the vicinity of the roller 6, and on either side thereof, i.e. they are substantially parallel to the axis of rotation 61–62 thereof. This disposition makes it possible to avoid impeding the flow of air that can take place between the tank 2 and the walls of the housing 10 of the appliance 1 (arrow B) and also inside the U-shape (arrow B'). The tank 2 is extended by a duct 2010 which comes flush with the surface of the wall of the housing 10. This duct is closed by a waterproof plug 201. On either side of the roller 6, and approximately over the working length thereof, capillary brushes, felts, or cloths bear at one end 80 against the skin P to be moistened and are held via their opposite ends 81 in grooves 22 provided for this purpose in the bottom portion of the tank 2. Above these capillary brushes, felts, or cloths, the tank is pierced by at least one opening 200 that is calibrated to pass a flow rate of fluid that is small and that increases because of vibration whenever the motor 3 is revolving, thereby achieving an adequate nominal flow rate. The fan member 4 blows air coming from an orifice 100 in the wall of the housing 10 towards the inside 110 of the wall of the housing 10, from which it escapes on either side of the felts 8, as mentioned above: i.e. via arrows B and B'. This gives rise to forced evaporation of the water that has been deposited on the skin P, thereby cooling the skin.

Figure 7:
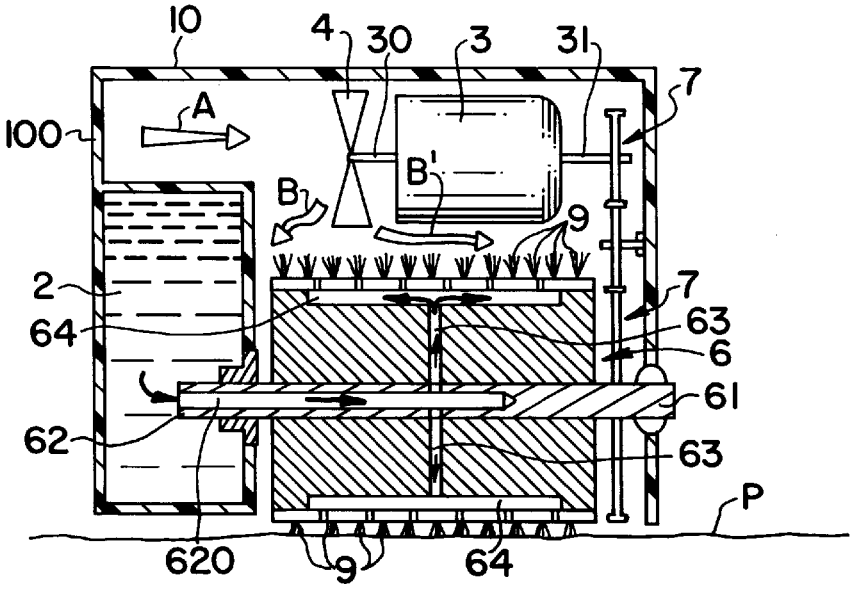
FIG. 7 is a diagram of a third embodiment in which moistening is obtained by spraying.

In another embodiment, moistening of the skin is achieved by spraying. An example of this particular embodiment is shown diagrammatically in FIG. 7.

In the example shown, the epilator roller 60 is provided with a shaft that is hollow, at least in part, with the end 62 of a channel 620 formed in said shaft 62–61 being in communication with the fluid tank 2. Transverse and peripheral channels 63 and 64 communicate with the axial channel 620 and enable brushes 9 disposed on the periphery of the roller 60 to be soaked. These brushes 9 that come into contact with the skin P serve to moisten it. Rotation of the roller 60 sets up suction that causes the fluid taken from the tank 2 to flow towards the brushes 9.

As before, the motor 3 drives the roller 60 via a set of gears 7 or via equivalent members. The motor 3 also drives a blower 4, that sucks in fresh air (arrow A) via an opening 100 formed through the wall of the housing 10 and propel it (arrows B and B') towards the epilator means 6 and the skin P, thereby reducing the surface temperature thereof and achieving the looked-for numbing.

Figure 8:
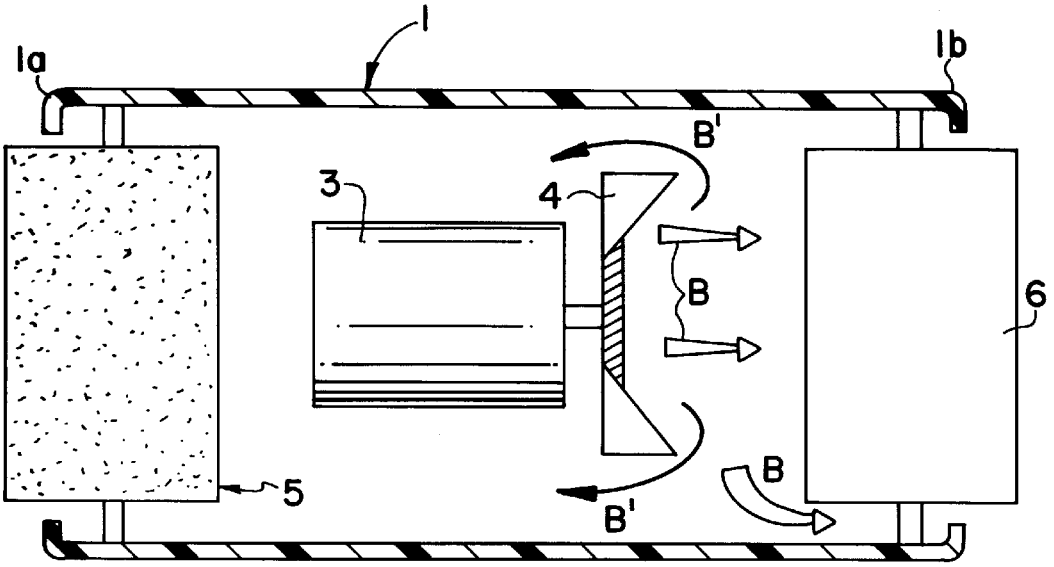
FIG. 8 is a diagram of a fourth embodiment in which moistening and epilation are performed one after the other.

In another embodiment, as shown in FIG. 8, the means 5 for moistening the skin P and the means 6 for pulling out hairs are disposed at respective opposite ends 1*a* and 1*b* of the appliance 1.

The moistening means 5 may be similar to any of the devices described with reference to other embodiments, e.g. a roller with an incorporated tank, or a spraying device.

Drying means 4, e.g. a fan 4 driven by the motor 3, are disposed between the moistening means 5 and the means 6 for pulling out hairs.

Air is caused to leave the appliance 1 via both of its ends 1*a* and 1*b*, as illustrated by arrows B and B'.

Thus, in use, the skin P is initially moistened by applying the end la of the appliance 1 against the skin P, with the fan 4 in operation so as to enable the skin P to be cooled (i.e. its temperature to be reduced).

Thereafter the user turns the appliance the other way up to make use of its opposite end 1*b* which is fitted with the epilator roller 6. The motor 3 continues to drive the fan 4 while epilation is taking place so as to continue drying and continue cooling the skin.

Thus, epilation is performed on a skin P that is both dry and cooled.

Figure 9:
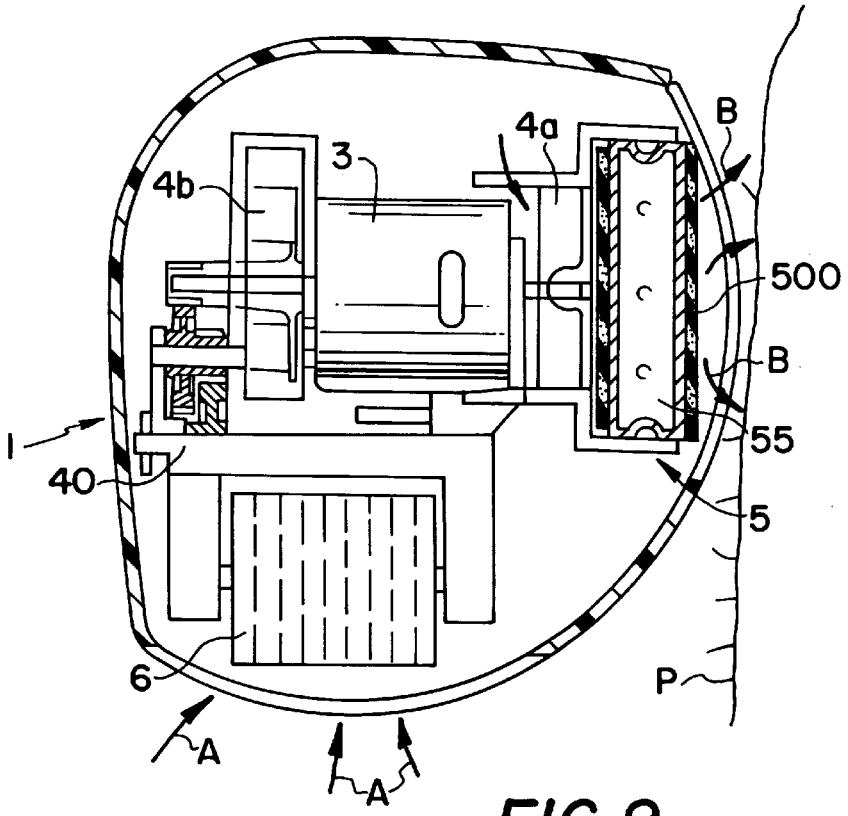
FIGS. 9 and 10 show a variant of the FIG. 8 embodiment.
Figure 10:
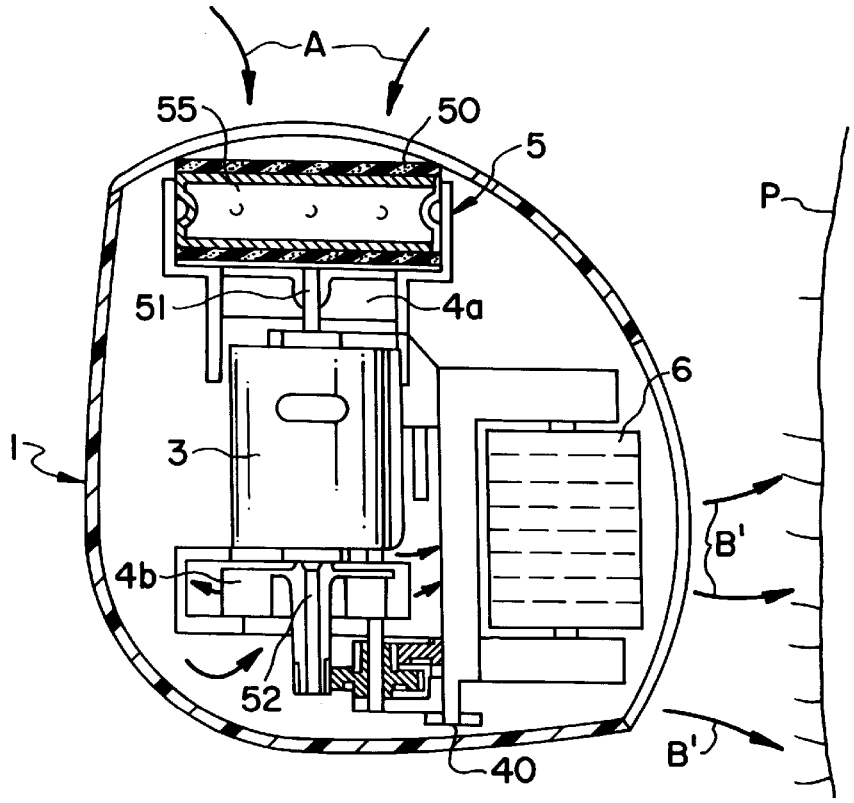

In a preferred embodiment of the invention, as shown in FIGS. 9 and 10, the means 5 for moistening the skin P, and the, means 6 for pulling out hairs are disposed along two respective adjacent sides of the appliance which is generally rectangular in section.

The epilator means 6 and the means 5 for moistening the skin are disposed at right angles relative to each other.

Thus, if the moistening means 5 are constituted by a roller 55, e.g. with an incorporated tank, then the axis of the roller 55 is substantially orthogonal to the axis of rotation of the epilator means 6.

The drying means comprise two fans 4*a* and 4*b* driven by the motor 3.

One of the fans 4*a* is an axial blower, while the other fan 4*b* is a centrifugal blower.

In this embodiment, the motor 3 has a shaft that is essentially parallel to the axis of rotation of the-epilator means 6.

Each of the fans 4*a* and 4*b* is mounted at a respective end of the shaft of the motor 3 via a respective freewheel 51, 52 such that depending on its direction of rotation, the motor 3 drives one or other of the fans 4*a* and 4*b* in alternation.

A selector (not shown) is provided on the body of the appliance 1 for changing the direction of rotation of the motor 3.

Thus, in use, the skin P is initially moistened by the moistening means 5, as illustrated in FIG. 9.

The selector is put in a first position such that the motor 3 rotates in a first direction, thereby driving the fan 4*a* disposed behind the moistening means 5. The other fan 4*b* and the epilator means 6 remain stationary because of the freewheel 52.

The appliance is placed against the skin P.

Air enters into the appliance, in particular via the opening provided level with the epilator means 6 (arrow A) and it is channeled by the fan 4*a* onto the axis of rotation of the fan 4*a* and of the motor 3 so as to be ejected, from the appliance via the opening through which the moistening means 5 project (arrow B).

This serves to cool the skin P.

During a second stage of use, the appliance is pivoted through one-fourth of a turn so as to bring the epilator means 6 into contact with the skin P.

The user switches on the epilator means 6 by moving the selector to its second position.

The motor 3 is then driven in the opposite direction so as to rotate the other fan 4*b* and the epilator means 6.

The fan 4*a* then remains stationary because of the freewheel 51.

As shown in FIG. 10, air enters into the appliance (arrow A) via the opening provided in the body thereof and through which the now-stationary moistening means 5 project.

The fan 4*b* disposed behind the epilator means 6 on an axis of rotation parallel to the axis of rotation of the epilator means 6 is provided to have a centrifugal effect on the air so as to eject air towards the epilator means 6 and thus out from the appliance 10 (arrow B').

Thus, while epilation is taking place, the skin P continues to be dried and cooled, thereby further attenuating pain.

The freewheel 51 could also be omitted such that during epilation, the fan 4*a* continues to rotate but in the opposite direction to its direction of rotation during the moistening stage, thereby further improving the cooling effect on the skin.

Figure 11:
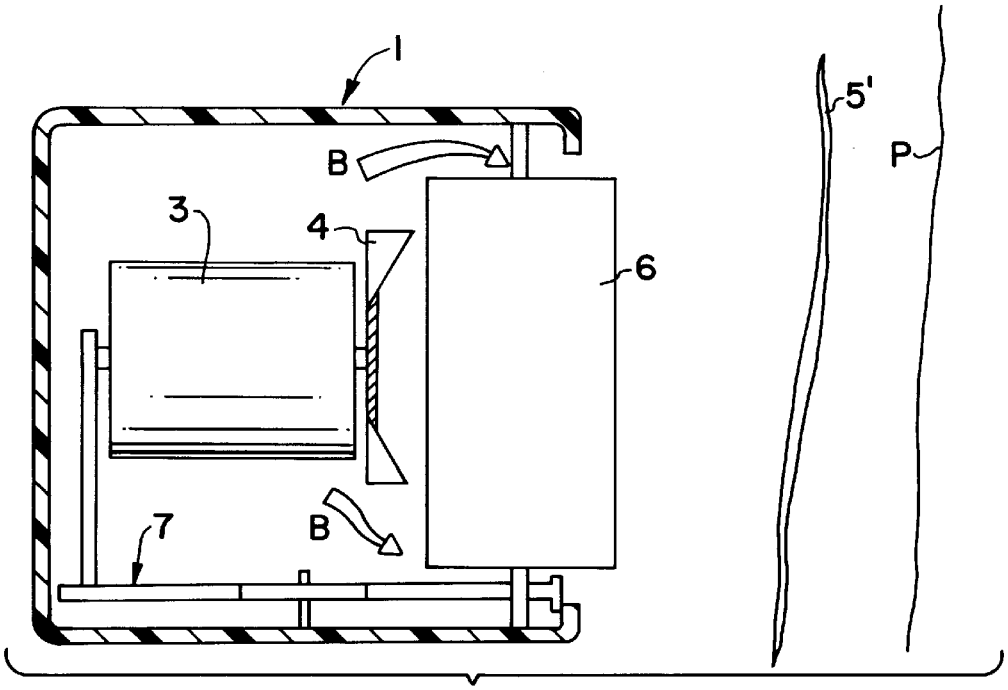
FIG. 11 is a diagram of a fifth embodiment in which moistening is obtained by external means.

In another version of the invention, as shown in FIG. 11, the means 5' for moistening the skin P are external to the epilator 1 and are constituted by a piece of cloth, sponge, felt, etc. 5' impregnated with a fluid.

The appliance then includes a fan positioned behind the epilator means 6. The epilator means are driven by a motor 3 that serves also to drive the fan 4.

The epilator means 6 are nevertheless declutchable from the motor 3 so as to allow the fan to be used on its own in order to col the skin prior to epilation.

Thus, the user moistens the portion of the skin P to be epilated by means of a damp cloth 5'. Thereafter, initially, the appliance 1 is moved over the skin P while the epilator means 6 are stationary and the fan 4 is blowing air in the direction of arrows B.

The skin is thus dried and cooled.

Then, while continuing to apply ventilation so as to continue cooling the skin P, the epilator means 6 are put into operation.

Such a system makes it possible to provide better control over the amount of water placed on the skin P.

Naturally, the invention is not limited to the particular variant embodiments specifically described with reference to the figures.

In particular, although it has been implicitly assumed that the blower should be driven by the same drive motor as the epilator means, and even though such a configuration is advantageous, there is no reason for that necessarily to be the case, and an additional motor could be provided to drive the blower.

Also, the particular configuration of the appliance, specifically the configuration of the housing and the disposition in three dimensions inside the housing of the component elements of the appliance, namely the motor, the tank, etc., all depend on technological and/or ergonomic choices that are within the competence of the person skilled in the art.

As already mentioned, electrical power may be provided from an external power supply connected to mains, or preferably from cordless means such as batteries, rechargeable or otherwise. Nor is it possible to exclude the use of epilator means driven by means that are purely mechanical: e.g. a clockwork motor.

We claim:

1. A mechanical epilator (1) for pulling out hairs from the skin, the epilator comprising a portable housing (10) containing epilator means (6) for pulling out of hairs from the skin (P), drying means (4*a* and 4*b*) for drying the skin, and drive means (3, 7) for driving the epilator means, in combination with means (2, 5, 5') for moistening the skin with a liquid, wherein said drying means dry the skin (P) after the skin has been moistened by said means for moistening so as to obtain evaporation of the liquid, the evaporation producing a cooling of the skin, wherein the cooling of the skin causes at least partial numbness of the skin while hairs are being pulled out of the skin by said epilator means.

2. An epilator according to claim 1, wherein said means (2, 5) for moistening the skin (P) are incorporated in said housing.

3. An epilator according to claim 2, wherein said means (5) for moistening the skin comprise a moistening roller (50) rotatable about a shaft (51, 52), the roller having a peripheral surface, and a tank (2) feeding said moistening roller (50) with the liquid, and a zone of the peripheral surface of the roller (50) is in contact with the skin (P) in order to moisten the skin.

4. An epilator according to claim 2, wherein: said moistening means (5) comprise a liquid tank (2) and a moistening roller (50), rotatable about a shaft (51, 52) that is hollow at least in part so as to define a channel for the flow of said liquid, said channel communicating (21) with said tank, the roller having a peripheral surface, and said channel being provided with orifices allowing said liquid to escape towards the peripheral surface of the roller (50) in order to moisten the skin (P) when the roller (50) is in contact with the skin.

5. An epilator according to claim 2, wherein said moistening means (5) comprise a roller having a hollow interior bounded by a cylindrical wall (55); the roller is rotatable about a shaft (51, 52) and is provided with orifices (552) through the cylindrical wall; the hollow interior of said roller (55) is designed to receive the liquid; and the roller is provided with a peripheral ring (500) of hydrophilic material receiving the liquid via said orifices (552) and moistening the skin (P) when the moistening means (5) are in contact with the skin.

6. An epilator according to claim 2, wherein said moistening means comprise at least one tank (2, 2') containing liquid and having an open end (22), and an element (8, 8') of hydrophilic material disposed in the open end and extending from the open end to contact and moisten the skin.

7. An epilator according to claim 6, wherein said at least one tank comprises two tanks (2, 2') disposed on either side of the epilator means (6).

8. An epilator according to claim 6, wherein said tank (2) has the form of a horizontal U-shape, and has branches which are disposed on either side of the epilator means (6).

9. An epilator according to claim 8, wherein the element made of hydrophilic material (8) has one end (81) held in a groove (22) provided in a bottom portion of the tank (2), said tank being pierced above the element made of hydrophilic material by at least one calibrated opening (200) for allowing a small flow rate of the liquid to pass through the calibrated opening.

10. An epilator according to claim 2, wherein said epilator means (6) are in the form of a roller (60) which has a periphery and which is rotatable about a shaft (61, 62) that is hollow at least in part so as to form a circulation channel (620) for circulation of the liquid, said moistening means comprise a tank (2) containing the liquid, said tank communicating with said channel (620), and brushes (9) disposed at the periphery of the roller (60), and said epilator means are provided with channels (63, 64) communicating with said circulation channel (620) and distributing the liquid to the brushes (9) in such a manner as to moisten the skin (P) by spraying when said epilator means (6) are in contact with the skin.

11. An epilator according to claim 2, wherein the means (5) for moistening the skin (P) and the epilator means (6) are disposed at respectively opposite ends (1*a*, 1*b*) of the housing (10) and the drying means (4) being disposed between the moistening means (5) and the epilator means (6).

12. An epilator according to claim 2, wherein said housing has two sides that are adjacent one another and the means (5) for moistening the skin and the epilator means (6) are each disposed along a respective one of the two adjacent sides of the housing (10).

13. An epilator according to claim 12, wherein the drying means comprise two fans (4*a*, 4*b*) actuated by a motor (3), each fan (4*a*, 4*b*) being mounted at one end of a drive shaft of the motor (3) via a respective freewheel (51, 52) such that the motor drives one or other of the fans (4*a*, 4*b*) in alternation, depending on the direction of rotation of the motor.

14. An epilator according to claim 13, wherein one of the fans (4*a*) is an axial blower, while the other fan (4*b*) is a centrifugal blower.

15. An epilator according to claim 3, wherein the tank (2) is provided with at least one orifice (200) facing the roller (50), and a gap of determined thickness (d) is left between the roller (50) and the tank (2), where by the liquid flowing out of the tank via the at least one orifice forms a film of liquid at the peripheral surface of the roller by capillarity and the film of liquid is applied to the skin as the roller moves over the skin.

16. An epilator according to claim 15, wherein said tank (2) is provided with a plurality of orifices (200) disposed along a line parallel to the shaft.

17. An epilator according to claim 3, wherein said roller (50) includes a hydrophilic material in at least a part of the peripheral surface.

18. An epilator according to claim 3, wherein said tank (2) has a filling opening and a plug (201, 54) for sealing the filling opening.

19. An epilator according to claim 1, wherein the means (5') for moistening the skin (P) are external to said epilator (1) and are constituted by a liquid-impregnated cloth (5').

20. An epilator according to claim 1, wherein said means for drying the skin (P) comprise at least one fan (4*a*, 4*b*) driven by an electric motor (3) that generates a jet of air (B. B') at ambient temperature directed towards the skin (P) in a region which has been moistened in order to cool the skin so as to produce the numbness.

21. An epilator according to claim 1, wherein the liquid is water, a substance more volatile than water, or a hypoallergenic substance.

* * * * *